US011339930B1

(12) United States Patent
Workman

(10) Patent No.: US 11,339,930 B1
(45) Date of Patent: May 24, 2022

(54) COLOR MIXING LIGHTING DEVICE

(71) Applicant: Rob Workman, Oklahoma City, OK (US)

(72) Inventor: Rob Workman, Oklahoma City, OK (US)

(73) Assignee: Jasco Products Company, LLC, Oklahoma City, OK (US)

( * ) Notice: Subject to any disclaimer, the term of this patent is extended or adjusted under 35 U.S.C. 154(b) by 67 days.

(21) Appl. No.: 17/135,851

(22) Filed: Dec. 28, 2020

(51) Int. Cl.
*F21K 9/62* (2016.01)
*F21V 9/40* (2018.01)
*F21V 3/02* (2006.01)
*F21Y 115/10* (2016.01)

(52) U.S. Cl.
CPC ..... *F21K 9/62* (2016.08); *F21V 3/02* (2013.01); *F21V 9/40* (2018.02); *F21Y 2115/10* (2016.08)

(58) Field of Classification Search
CPC ..... F21K 9/62
USPC ..... 362/311.02
See application file for complete search history.

(56) References Cited

U.S. PATENT DOCUMENTS

2001/0021109 A1* 9/2001 Schleifer ..... F21V 7/0008 362/231
2010/0124243 A1* 5/2010 Hussell ..... F21K 9/64 372/45.01
2011/0235323 A1* 9/2011 Allegri ..... F21V 7/0008 362/232
2011/0310587 A1* 12/2011 Edmond ..... G02B 6/0003 362/84
2012/0206933 A1* 8/2012 Isogai ..... F21V 23/006 362/555
2013/0207533 A1* 8/2013 de Koning ..... F21V 3/04 313/46
2015/0241025 A1* 8/2015 Steiner ..... F21V 33/0052 362/23.05
2016/0320002 A1* 11/2016 Tai ..... F21K 9/61
2017/0059119 A1* 3/2017 Bennett ..... F21V 3/02
2020/0224851 A1* 7/2020 Baranoff ..... A46B 9/021

* cited by examiner

*Primary Examiner* — Bryon T Gyllstrom
(74) *Attorney, Agent, or Firm* — William D. Popejoy

(57) ABSTRACT

The present invention pertains to devices and applications for lamps to produce color mixing effects with a desired color distribution output within a translucent cylindrical housing. More specifically, the invention pertains to a device or devices that utilize a multidirectional light engine constructed in opposite directions with programmed light intensity with a spatial distribution of photons at single or varying wavelengths, which result in a large percentage of those photons entering the translucent cylinder producing a non-linear effect being emitted from the cylinder. Embodiments use two or more coaxial light engines with programmed light intensities producing a variety of non-linear lighting effects, which emit the majority of the light rays in opposing directions within a dedicated color mixing chamber. In some embodiments, the color mixing lighting device comprises two or more coaxial light engines which beam light in a 360 degree radial pattern forming an approximate 110 degree cone.

15 Claims, 2 Drawing Sheets

COLOR MIXING LIGHTING DEVICE

BACKGROUND OF THE INVENTION

1. Field of the Invention

The present invention pertains to devices and applications for lamps to produce color mixing effects with a desired color distribution output within a translucent cylindrical housing. More specifically, the invention pertains to a device or devices that utilize a multidirectional light engine constructed in opposite directions with programmed light intensity with a spatial distribution of photons at single or varying wavelengths, which result in a large percentage of those photons entering the translucent cylinder producing a non-linear effect being emitted from the cylinder.

2. Description of the Related Art

Historically, color LED lamps desire a uniform intensity and color distribution. Various light mixing methods are utilized throughout the industry, produced by the mixing of color or colors within the lamp housing creating a uniform light output.

U.S. Pat. No. 9,736,895 discloses color mixing within a multi-color LED illumination device. The structure teaches the production of a uniform color throughout an output light beam.

U.S. Pat. No. 9,484,329 discloses lamps, luminaries or solid state lighting components having multiple discrete light sources whose light combines to provide the desired emission characteristics.

U.S. Pat. No. 8,937,692 discloses color mixing lens which can improve color reproducibility. The structure teaches a color mixing lens including a light receiving portion having at least two light emission diodes positioned at a side for emitting color lights different from each other.

SUMMARY OF THE INVENTION

Embodiments described for the present invention use two or more coaxial light engines with programmed light intensities producing a variety of non-linear lighting effects, which emit the majority of the light rays in opposing directions within a dedicated color mixing chamber. The color mixing lighting device emits light rays through a translucent cylindrical housing.

In some embodiments, the color mixing lighting device comprises two or more coaxial light engines which beam light in a 360 degree radial pattern forming an approximate 110 degree cone, and a spatial distribution of photons at single or varying wavelengths which result in a large percentage of those photons entering the color mixing chamber producing a non-linear effect being emitted through the translucent cylinder.

In another embodiment of the invention, the color mixing lighting device comprises two or more coaxial light engines programmed to coordinate patterns of wavelengths and intensity to provide non-linear effects.

It should be appreciated that combinations of the foregoing concepts and additional concepts discussed in greater detail below are contemplated as being part of the inventive subject matter disclosed herein. In particular, all combinations of claimed subject matter appearing at the end of this disclosure, or elsewhere herein, are contemplated as being part of the inventive subject matter.

These and other systems, methods, objects, features, and advantages of the present invention will be apparent to those skilled in the art from the following detailed description of the preferred embodiment and the drawings.

BRIEF DESCRIPTION OF THE DRAWINGS

One or more embodiments are illustrated by way of example, and not by limitation, reference will now be made to the accompanying drawings, having the same numeral designations to represent like elements throughout and wherein.

Figure 1:
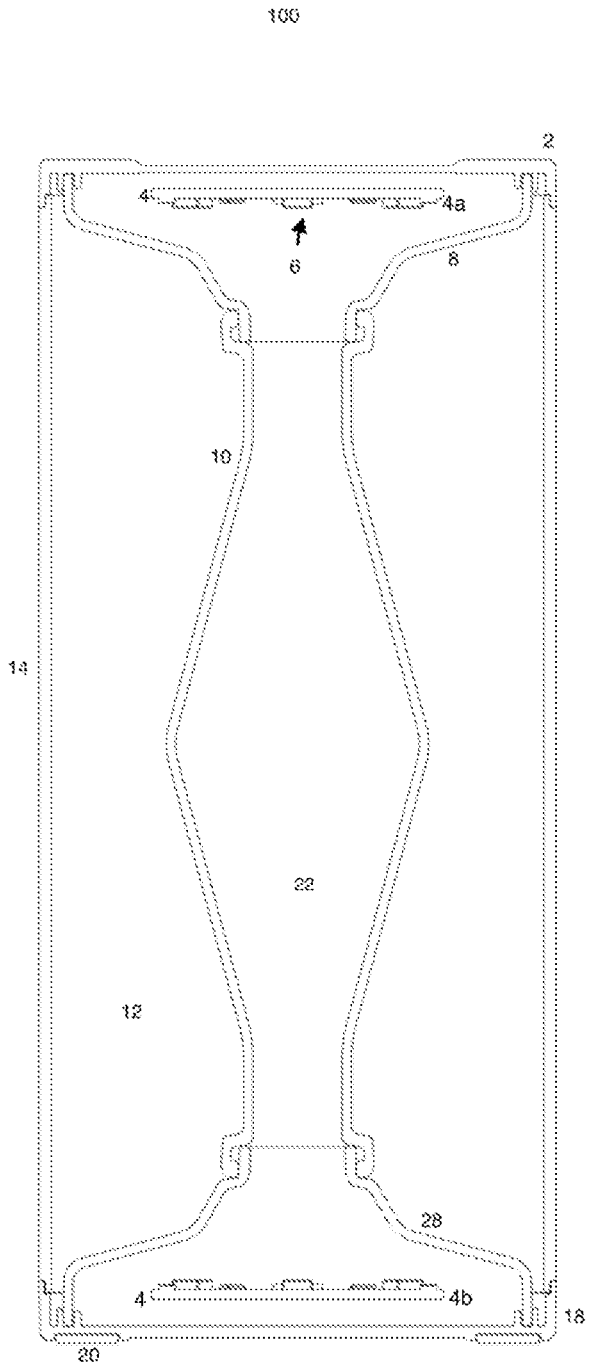
FIG. 1 is a front sectional view of a color mixing lighting device.

While the invention has been described in connection with certain preferred embodiments, other embodiments would be understood by one of ordinary skill in the art and are encompassed herein.

ELEMENTS WITH CORRESPONDING REFERENCE NUMERALS

Color Mixing Lighting Device 100
Lighting Device Top 2
Coaxial Light Engines 4
Top Light Engine 4*a*
Base Light Engine 4*b*
LED Light 6
Top Support Structure 8
Coaxial Center Support 10
Coaxial Center Support Part A 10*a*
Coaxial Center Support Part B 10*b*
Color Mixing Chamber 12
Translucent Cylinder 14
Bolts 16
Base 18
Stabilization Ring 20
Inner Chamber 22
USB C printed circuit board 26
Base Support Structure 28

DETAIL DESCRIPTION OF THE INVENTION

The claimed subject matter is described with reference to the drawings, wherein like reference numerals are used to refer to like elements throughout. In the following description, for purposes of explanation, numerous specific details are set forth in order to provide a thorough understanding of the subject innovation. It may be evident, however, that the claimed subject matter may be practiced without these specific details. Well-known structures and devices are shown in order to facilitate describing the subject innovation. Moreover, it is to be appreciated that the drawings may not be to scale.

FIG. 1 is a front sectional view of a color mixing lighting device 100. The color mixing lighting device 100 may include a variety of additional components. The color mixing lighting device 100 generates a color mixing emission generated by two or more coaxial light engines 4. The two or more coaxial light engines 4 emit a majority of the light rays in an opposing orientation. The light rays from the two or more coaxial light engines 4 first meet in an inner chamber 22. The inner chamber 22 is created by the space void within the coaxial center support 10. The coaxial center support 10 may be constructed of a highly reflective material. Light rays emitted from the surface of LEDs will travel parallel relative to the axis of the coaxial center support 10. The protruding convex surfaces of the coaxial center support 10 are struck and reflect the parallel light rays at their incident angles into the color mixing chamber 12 and onto the inner surface of the translucent cylinder 14. A maximum amount of LED light is harvested from the color mixing lighting device 100. The color mixing and non-linear performance is a function of dimensional relationships as well as optical properties of the material and performance. Overall product size is variable as long as the relative dimensional relationships are maintained.

The coaxial center support 10 provides two primary functions. First, the coaxial center support 10 allows reflection and refraction of light rays which contribute to color mixing in the inner chamber 22 that increases the generation of non-linear light. Secondly, the coaxial mechanical member serves as a mechanical backbone which holds together the two coaxial light engines 4. A programmed light intensity produces a variety of non-linear lighting effects. The non-linear lighting effects and controls the actions and functions by receiving inputs from different components of the device and sending signals to different parts of the device. The action components of the color mixing lighting device 100 are the white and RGB color LEDs. A Micro Controller Unit (MCU) directly controls the LEDs. This MCU as programmed sends the top light engine 4*a* white and color LEDs signals that directly controls all of the LED dies light intensity output. In exactly the same fashion the MCU send out signals to the base light engine 4*b*. The timing and coordination of the top light engine 4*a* and bottom light engine 4*b* wavelengths and intensities are all a product of the MCU's program and its execution.

The two or more coaxial light engines 4 beam light in a 360-degree radial pattern forming an appropriate 110 degree cone. The LEDs 6 from the coaxial light engines 4 are specifically engineered to be spatially arranged to facilitate the production of the desired non-linear lighting effect. The LED 6 arrangement produces a spatial distribution of photons at single or varying wavelengths which result in a large percentage of those photons entering the color mixing chamber 12 producing a non-linear light effect being emitted from the translucent cylinder 14.

In some embodiments, the two or more coaxial light engines 4 are programmed to coordinate patterns of wavelength and intensity to provide non-linear lighting effects. The non-linear lighting effects are primarily produced in the color mixing chamber 12. Light rays produced from the two or more coaxial light engines 4 initially meet in the inner chamber 22 created by the coaxial center support 10. The light rays are reflected and refracted by the coaxial center support 10. The light rays then meet in the dedicated color mixing chamber 12 where they combine to form a variety of programmable non-linear lighting effects. The MCU is programmed by the manufacturer to perform and execute its functions. The consumer can direct the actions and operation of the color mixing lighting device 100 by a single selection touch button located coaxially with the translucent cylinder 14 and parallel to the top surface of the top plate 2. This touch button uses capacitive touch technology to record push button presses by the operator.

Figure 2:
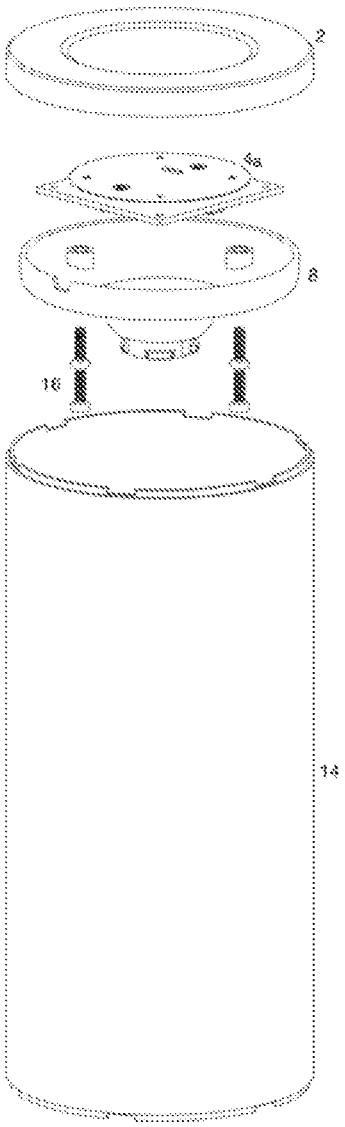
FIG. 2 is a partial exploded view of a color mixing lighting device.

FIG. 2 is a partial exploded view of a color mixing lighting device 100. A lighting device top 2 attaches to a translucent cylinder 14. The translucent cylinder 14 allows non-linear lighting effects created primarily within the color mixing chamber 12 (not shown) to be visible. A top support structure 8 may be affixed to the lighting device top 2 with the use of one or more bolts 16. The top support structure 8 then affixes to the coaxial center support 10 (not shown). The top support structure 8 and the coaxial center support 10 may connect in any variety of way to one having skill in the art, including: locking mechanism, screw-on, bolts, snap-on, etc.

One of two or more coaxial light engines 4 is affixed within the top support structure 8. The top support structure 8 is engineered to allow a specific shape of light to enter the inner chamber 22 created by the coaxial center support 10. The top support structure 8 and base support structure 28 not only serve to mechanically support the assembly of the lighting device top 2 and base 18 but the two support structures also serve to optically diffuse the spatial distribution of LED light rays coming from the two or more coaxial light engines 4 LEDs. Given that all generated light rays of the lamp pass through these two support structures, any occurrences of non-linear light would be a function of the LED light rays of the lamp and the ambient light present.

Figure 3:
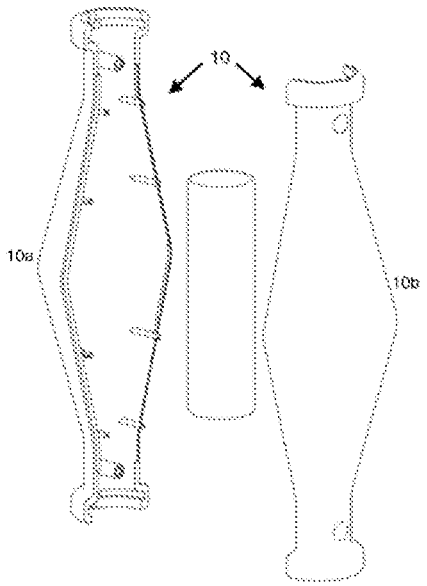
FIG. 3 is another partial exploded view of a color mixing lighting device.

FIG. 3 is another partial exploded view of a color mixing lighting device 100. The coaxial center support 10 is created by a two piece structure which forms together. An inner chamber 22 is created by the void space within the coaxial center support 10. Light rays reflect and refract on and through the coaxial center support 10. The engineered manipulation of the light rays creates an initial color mixing within the inner chamber 22 and the inner cylinder 24, which increase the generation of non-linear light.

Coaxial center support part A 10*a* and coaxial center support part B 10*b* combine to form the coaxial center support 10. The coaxial center support provides a structural framework for the color mixing lighting device 100. The two or more coaxial light engines 4 (not shown) are structurally supported by the coaxial center support 10.

Referring back to FIG. 1, light rays reflect and refract on and through the coaxial center support 10 and enter the light mixing chamber 12. The color mixing chamber 12 is created by the space within the translucent cylinder 14 and outside of the coaxial center support 10. A programmed light intensity produces a variety of non-linear lighting effects within the color mixing chamber 12. The non-linear lighting effects and controls the actions and functions by receiving inputs from different components of the device and sending signals to different parts of the device.

Figure 4:
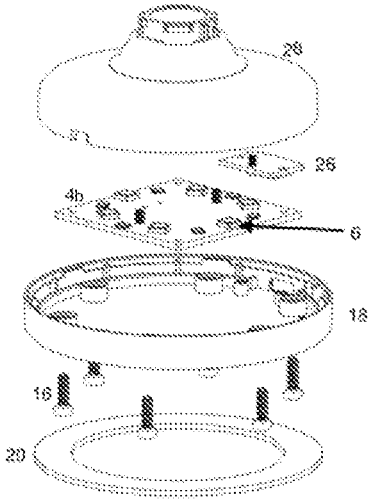
FIG. 4 is another partial exploded view of a color mixing lighting device.

FIG. 4 is another partial exploded view of a color mixing lighting device 100. The base support structure 28 attaches to the coaxial center support 10 (not shown). One or more coaxial light engines 4 are affixed beneath the base support structure 28 and above the base 18. Bolts 16 may affix the base support structure 28 to the base 18. A stabilization ring 20 is attached to the bottom of the base 18. The stabilization ring 20 provides the color mixing lighting device 100 with enhanced grip to a horizontal surface, improving overall stability of the device. A USB C printed circuit board 26 mounts to a female USB C receptacle and passes USB C power from this PCB onto the bottom light engine 4 PCB.

Although the present invention has been described in relation to particular embodiments thereof, many other variations and modifications will become apparent to those skilled in the art. It is preferred, therefore, that the present invention be limited not by the specific disclosure herein, but only by the appended claims. Alternative embodiments may be devised without departing from the spirit or scope of the invention. Further, the particular feature or structure may be combined in any suitable manner in one or more embodiments.

What is claimed is:

1. A lighting device generating a color mixing light emission comprising:

two or more coaxial light engines;

a translucent cylinder;

a color mixing chamber;

the two or more coaxial light engines emit a majority of the light rays in an opposing orientation;

a coaxial center support;

the coaxial center support comprises convex surfaces composed of reflective material which protrude to reflect parallel light rays at incident angles into the color mixing chamber and onto an inner surface of the translucent cylinder; and a programmed light intensity which produces a variety of non-linear lighting effects.

2. The lighting device as claimed in claim 1 further comprising:

the two or more coaxial light engines beam light in a 360 degree radial pattern forming an approximate 110 degree cone.

3. The lighting device as claimed in claim 1 further comprising:

a spatial distribution of photons at single or varying wavelengths which result in a large percentage of the photons entering the translucent cylinder to produce a non-linear effect being emitted from the cylinder.

4. The lighting device as claimed in claim 1 further comprising:

a micro controller unit; and the micro controller unit controls the light intensity output to the two or more coaxial light engines; and the micro controller unit controls wavelength distance emitted from the two or more coaxial light engines.

5. The lighting device as claimed in claim 1 further comprising:

one or more touch buttons;

the one or more touch buttons records presses by an operator; and the one or more touch buttons may use capacitive touch technology.

6. The lighting device as claimed in claim 1 further comprising:

a top support structure;

a base support structure; and the top support structure and the base support structure optically diffuse a spatial distribution of LED light rays emitted from the two or more coaxial light engines.

7. A lighting device generating a color mixing light emission comprising:

two or more coaxial light engines;

a translucent cylinder;

a color mixing chamber;

the two or more coaxial light engines emit a majority of light rays in an opposing orientation;

a programmed light intensity which produces a variety of non-linear lighting effects;

the two or more coaxial light engines beam light in a 360 degree radial pattern forming an approximate 110 degree cone;

a coaxial center support;

the coaxial center support comprises convex surfaces composed of reflective material which protrude to reflect parallel light rays at incident angles into the color mixing chamber and onto an inner surface of the translucent cylinder; and a spatial distribution of photons at single or varying wavelengths which result in a large percentage of the photons entering the translucent cylinder to produce a non-linear effect being emitted from the translucent cylinder.

8. The lighting device as claimed in claim 7 further comprising:

the two or more coaxial light engines programmed to coordinate patterns of wavelength and intensity to provide non-linear lighting effects.

9. The lighting device as claimed in claim 7 further comprising:

a micro controller unit; and the micro controller unit controls the light intensity output to the two or more coaxial light engines; and the micro controller unit controls wavelength distance emitted from the two or more coaxial light engines.

10. The lighting device as claimed in claim 7 further comprising:

one or more touch buttons;

the one or more touch buttons records presses by an operator; and the one or more touch buttons may use capacitive touch technology.

11. The lighting device as claimed in claim 7 further comprising:

a top support structure;

a base support structure; and the top support structure and the base support structure optically diffuse the spatial distribution of LED light rays emitted from the two or more coaxial light engines.

12. A lighting device generating a color mixing light emission comprising:

two or more coaxial light engines;

a translucent cylinder;

a color mixing chamber;

the two or more coaxial light engines emit a majority of the light rays in an opposing orientation;

a programmed light intensity which produces a variety of non-linear lighting effects;

a coaxial center support;

the coaxial center support comprises convex surfaces composed of reflective material which protrude to reflect parallel light rays at incident angles into the color mixing chamber and onto an inner surface of the translucent cylinder; and the two or more coaxial light engines programmed to coordinate patterns of wavelength and intensity to provide non-linear lighting effects.

13. The lighting device as claimed in claim 12 further comprising:

a micro controller unit; and the micro controller unit controls a light intensity output to the two or more coaxial light engines; and the micro controller unit controls wavelength distance emitted from the two or more coaxial light engines.

14. The lighting device as claimed in claim 12 further comprising:

one or more touch buttons;

the one or more touch buttons records presses by an operator; and the one or more touch buttons may use capacitive touch technology.

15. The lighting device as claimed in claim 12 further comprising:

a top support structure;

a base support structure; and the top support structure and the base support structure optically diffuse a spatial distribution of LED light rays emitted from the two or more coaxial light engines.

* * * * *